United States Patent [19]

Randall

[11] Patent Number: 4,899,423

[45] Date of Patent: Feb. 13, 1990

[54] ROPE CLEAT

[76] Inventor: Richard C. Randall, 27622 San Blas, Mission Viejo, Calif. 92692

[21] Appl. No.: 286,452

[22] Filed: Dec. 19, 1988

[51] Int. Cl.[4] ..... B63B 21/08; F16G 11/00

[52] U.S. Cl. ..... 24/134 R; 24/134 P; 114/218

[58] Field of Search ..... 24/134 R, 134 KB, 134 P; 114/218; 403/409.1, 314, 374

[56] References Cited

U.S. PATENT DOCUMENTS

| | | | |
|---|---|---|---|
| 598,776 | 2/1898 | Gosnell et al. | 24/134 KB |
| 892,258 | 6/1908 | Hosack | 24/134 P |
| 914,768 | 3/1909 | Walker et al. | 24/134 P |
| 1,783,433 | 12/1930 | Keller | 24/134 P |
| 2,226,393 | 12/1940 | Seeger | 24/134 P |
| 2,547,370 | 4/1951 | Boyer | 24/134 R |
| 4,084,532 | 4/1978 | Feder | 114/218 |
| 4,766,835 | 8/1988 | Randall et al. | 24/134 P |

*Primary Examiner*—Victor N. Sakran
*Attorney, Agent, or Firm*—Loyal M. Hanson

[57] ABSTRACT

A rope cleat having a base, a rope abutment structure on the base, a cam, and components for mounting the cam on the base so that the cam can rotate about a rotational axis for purposes of gripping a rope between the cam and the rope abutment structure is configured to better grip truck rope such as that fabricated from monofilament polypropylene. Teeth are provided on at least one of the cam and the rope abutment structure to provide edges disposed generally toward the other one of the cam and the rope abutment structure while a groove is provided to enhance the gripping of a rope having a known diameter against movement between the cam and the rope abutment structure along a path that is generally tangential relative to the rotational axis. The groove has a width less than the known diameter of the rope and it extends transversly to the edges of the teeth so that each edge includes first and second segments separated by the groove, each of the first and second segments of each edge thereby having an end portion disposed toward the groove with which to grip the rope against such movement.

6 Claims, 1 Drawing Sheet

ROPE CLEAT

BACKGROUND OF THE INVENTION

1. Technical Field

This invention relates generally to rope cleats, and more particularly to a new and improved cam-type rope cleat that grips plastic truck rope more securely.

2. Background Information

A rope cleat mounts on a structure to which a tensioned rope is to be secured, such as the bed of a truck. Those referred to as cam-type rope cleats include a cam that rotates slightly to bear against the rope for this purpose. In addition to the cam, it includes a cam spindle upon which the cam rotates, a rope abutment structure against which the cam presses the rope, and a base on which the foregoing components are mounted, the base mounting on the truck bed or other such structure.

Operation proceeds by drawing the rope downward into the cleat between the cam and the rope abutment structure. There it is engaged by a toothed gripping surface on the cam. As the rope attempts to escape the cam, it pulls on the toothed gripping surface so that the cam tends to rotate slightly. This causes the teeth of the gripping surface to press more firmly into the rope until the rope is unable to be further compressed. At that point the cam can rotate no more so that movement of both the cam and the rope stops.

One such cam-type rope cleat is described in U.S. Pat. No. 4,766,835 to Randall, and that patent is incorporated herein by reference for the details of construction provided. Although the rope cleat it describes is very effective in many respects, it sometimes seems to hold plastic truck rope less securely than some other types of rope. In other words, the teeth do not seem to engage the relatively stiff plastic truck rope as securely as they do other rope, such as less stiff nylon rope.

Consequently, it is desirable to have a new and improved rope cleat that overcomes this concern—one designed to more securely grip truck rope.

SUMMARY OF THE INVENTION

This invention solves the problems outlined above by providing a groove transversing the teeth that results in better gripping engagement. Each of the teeth has what may be called a gripping edge and the groove extends transversely to the gripping edges so that each edge has two segments separated by the groove. Thus, each of the two segments of each gripping edge has an end portion disposed toward the groove in a positioned to bite into the rope more securely.

In other words, as the cam rotates slightly about a rotational axis to bear against the rope in the usual way, the rope is forced into the groove and against the end portions of the gripping edges of the teeth. This produces high-pressure-per-unit-area engagement of the rope by the end portions that more securely grips harder or stiffer truck rope (i.e., truck tie down rope such as the ½-inch diameter truck rope manufactured from monofilament polypropylene that is available under the product name TWISTED POLYPRO TRUCK ROPE, Catalog No. 34556, from Wellington Puritan of Madison, Ga.).

Generally, a rope cleat constructed according to the invention includes a base, a rope abutment structure on the base, a cam, and components for mounting the cam on the base so that the cam can rotate about a rotational axis for purposes of gripping a rope between the cam and the rope abutment structure. In addition, at least one of the cam and the rope abutment structure includes a plurality of teeth, each of which teeth has an edge disposed generally toward the other one of the cam and the rope abutment structure.

According to a major aspect of the invention, means are provided for enhancing gripping of a rope having a known diameter against movement between the cam and the rope abutment structure along a path that is generally tangential relative to the rotational axis, including a groove having a width less than the known diameter of the rope. The groove extends transversely to the edges of the teeth so that each edge includes first and second segments separated by the groove, each of the first and second segments of each edge thereby having an end portion disposed toward the groove with which to grip the rope against such movement.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
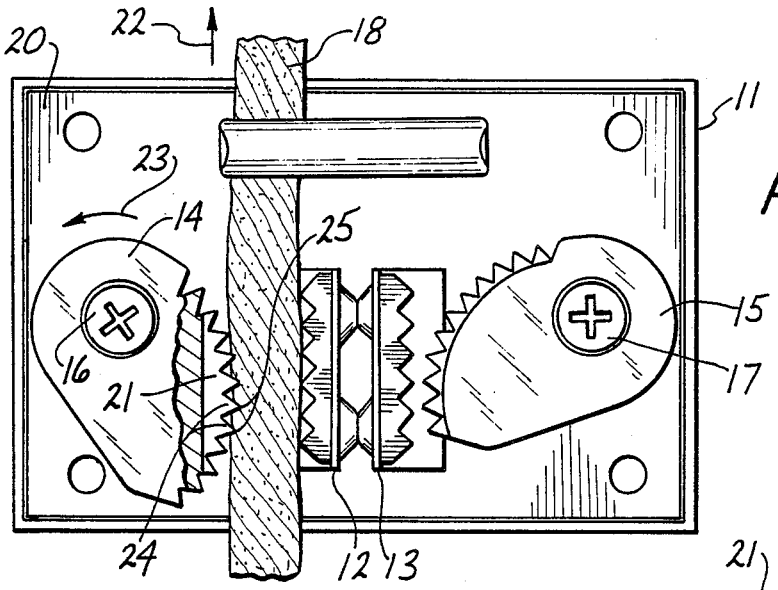
FIG. 1 of the drawings is a plan view of a rope cleat constructed according to the invention.
Figure 2:
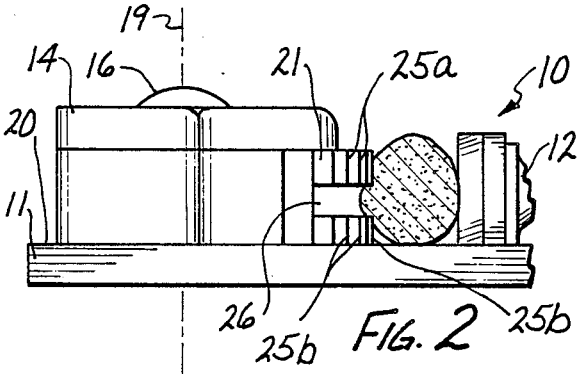
FIG. 2 is an enlarged, fragmentary, elevation view of a portion of the rope cleat.
Figure 3:
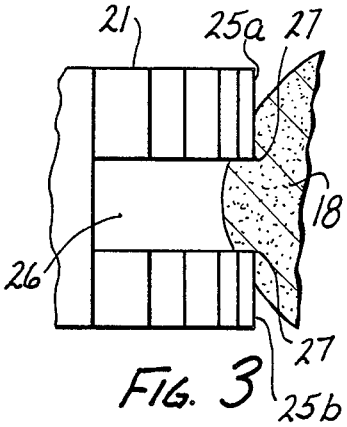
FIG. 3 is a further enlarged, fragmentary view showing details of the teeth.

Referring now to FIGS. 1–3 of the drawings, there is shown a rope cleat 10 constructed according to the invention. It includes a base 11 on which is mounted first and second rope abutment structures 12 and 13 and first and second eccentric members or cams 14 and 15. The base is configured so that it can be mounted by suitable means on a support structure to which a rope is to be secured (not shown). The first and second rope abutment structures 12 and 13 are mounted on the base 11 in the sense that they may be separate components or integrally attached in one-piece construction. The first and second cams 14 and 15 are mounted on the base 11 by suitable means, such as first and second screw-and-spindle arrangements 16 and 17, so that the cams 14 and 15 can rotate for purposes of gripping a rope, such as a rope 18 in FIGS. 1 and 2.

The rope cleat 10 is in many respects similar to the rope cleat described in the above referenced U.S. Pat. No. 4,766,835 to Randall. Therefore, many details of construction are not described further. Instead, reference is made to the above mentioned patent. Of course, a rope cleat constructed according to the invention can take any of various forms other than the precise structure disclosed in that patent without departing from the inventive concepts disclosed is this application. In addition, the first and second rope abutment structures 12 an 13 are generally similar to each other as are the first and second cams 14 and 15. Therefore, only the first rope abutment structure 12 and first cam 14 are described in further detail.

The first cam 14 has an eccentric shape and it is mounted so that it can rotate about a rotational axis 19 (FIG. 2) that is generally perpendicular to a generally planar, upper surface 20 of the base 11. Rotation tends to occur as the rope 18 attempts to escape from between the first cam 14 and the first rope abutment structure 12 because the first cam 14 has a gripping portion 21 that engages the rope 18. As the rope 18 attempts to escape in the direction of an arrow 22 in FIG. 1 (i.e., along a path that is generally tangential relative to the rotational axis 19), it pulls on the first cam 14 thereby tending to rotate it in the direction of an arrow 23. This results in the gripping portion 21 of the first cam 14 tending to move toward the first rope abutment structure 12 so that the rope 18 is gripped more securely between the first cam 14 and the first rope abutment structure 12.

The gripping portion 21 of the first cam 14 includes a plurality of teeth 24 (FIG. 1) directed toward the first rope abutment structure 12. In other words, each of the teeth 24 has a gripping edge, such as the edges 25 in FIG. 1, that is disposed generally toward the first rope abutment 12. These edges press against and engage the rope 18, and in the illustrated rope cleat 10 they extend generally parallel to the rotational axis 19.

According to a major aspect of the invention, the first cam 14 includes a groove 26 that extends transversely or generally perpendicular to the edges 25 of the teeth 24 so that each edge 25 includes first and second segments 25*a* and 25*b* (FIGS. 2 and 3) separated by the groove 26. This configuration results in each of the first and second segments 25*a* and 25*b* of each edge 25 having an end portion 27 disposed toward the groove 26 as illustrated in FIG. 3, and these end portions 27 grip the rope 18 in high-pressure-per-unit-area engagement.

In other words, the end portions 27 contact the rope 18 over a lesser surface area than the continuous gripping edges of the prior art. Greater pressure-per-unit-area results so that the end portions 27 better grip truck rope. This gripping action is further enhanced with a truck rope that is braided or similarly constructed so that it has an uneven surface that pyramidally shaped end portions 27 can grip better than the continuous gripping edges of the prior art. For this purpose, the groove 26 has a width (extending between the segments 25*a* and 25*b* of an edge 25) that is substantially less than the diameter of the rope 18, preferably between one-eighth and three-eighths inches wide for one-half inch diameter truck rope.

Figure 4:
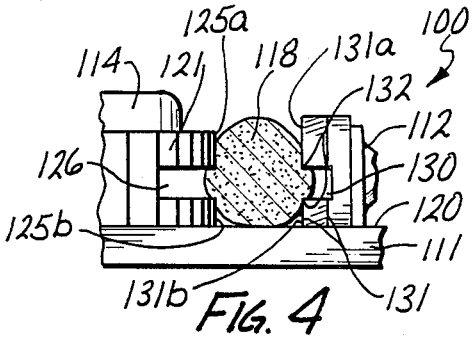
FIG. 4 is an enlarged, fragmentary, elevation view of a portion of another rope cleat having a groove in the abutment structure.

Considering now FIG. 4, there is shown another rope cleat that is designated rope cleat 100. It is generally similar to the rope cleat 10 so that all the parts are not described in detail. For convenience, many of the reference numerals designating parts of the rope cleat 100 are increased by one hundred over those designating similar parts of the rope cleat 10.

Unlike the rope cleat 10, the rope cleat 100 includes a second groove 130 in the rope abutment structure 112. The rope abutment structure 112 includes gripping edges 131 (similar to edges 25) so that the groove 130 results in segments 131*a* and 131*b* (similar to the segments 25*a* and 25*b*) that have end portions 132 (similar to the end portions 27). The end portions 132 provide additional high-pressure-per-unit-area gripping engagement of the rope 118.

Thus, in a rope cleat constructed according to the invention, at least one of the cam and the rope abutment structure includes a plurality of teeth, each of which teeth has an edge disposed generally toward the other one of the cam and the rope abutment structure, and a groove is provided that extends transversely to the edges of the teeth. In the rope cleat 100, both the cam 114 and the rope abutment structure 112 are so configured.

Figure 5:
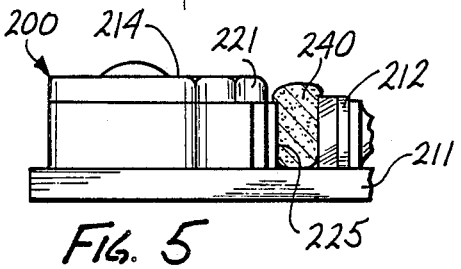
FIG. 5 PRIOR ART
FIG. 5 is a fragmentary elevation view of a portion of a prior art rope cleat holding a length of nylon rope.
Figure 6:
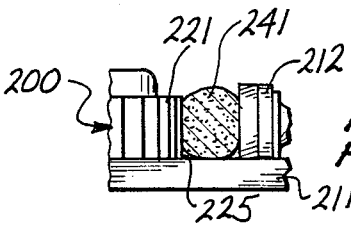
FIG. 6 PRIOR ART
FIG. 6 is a fragmentary elevation view showing the prior art rope cleat holding a length of truck rope.

FIGS. 5 and 6 illustrate a prior art rope cleat 200 utilizing reference numerals increased by two hundred over those designating similar parts of the rope cleat 10. Unlike the rope cleat 10, the prior art rope cleat 200 does not have a groove in either one of the gripping portion 221 of the cam 214 or the rope abutment structure 212. Thus, the gripping edge 225 contacts more of the rope 240 than occurs with the rope cleat 10.

In FIG. 5 the rope cleat 200 is shown gripping a less stiff rope 240, such as a nylon rope. It compresses more easily than truck rope and this enhances the gripping action. In FIG. 6, however, the rope cleat 200 is shown attempting to grip a stiffer or harder length of truck rope rope 241 which does not compress so easily. In that case, the gripping action is impaired.

Thus, this invention provides a groove in at least one of the cam and the rope abutment that results in better gripping engagement. Although an exemplary embodiment of the invention has been shown and described, many changes, modifications, and substitutions may be made by one having ordinary skill in the art without necessarily departing from the spirit and scope of the invention.

What is claimed is:

1. A rope cleat, comprising:

a base, a rope abutment structure on the base, a cam, and means for mounting the cam on the base so that the cam can rotate about a rotational axis for purposes of gripping a rope between the cam and the rope abutment structure;

the cam having a plurality of teeth, each of which teeth has an edge disposed generally toward the rope abutment structure; and means for enhancing the gripping of a rope having a known diameter against movement between the cam and the rope abutment structure along a path that is generally tangential relative to the rotational axis, including a groove in the cam that has a width less than the known diameter of the rope;

the groove extending transversely to the edges of the teeth so that each edge includes first and second segments separated by the groove, each of the first and second segments of each edge thereby having an end portion disposed toward the groove with which to grip the rope against such movement.

2. A rope cleat as recited in claim 1, wherein:

the base includes an an upper surface that is generally perpendicular to the rotational axis;

the means for mounting the cam on the base includes a spindle member on which the cam is mounted for rotation about the rotational axis;

the edges of the teeth extend generally parallel to the rotational axis; and the groove extends perpendicular to the edges of the teeth.

3. A rope cleat as recited in claim 1, wherein: the groove has a width that is substantially less than the known diameter of the rope.

4. A rope cleat as recited in claim 1, wherein the rope abutment structure includes:

a plurality of teeth, each of which teeth has an edge disposed generally toward the cam; and a groove having a width less than the known diameter of the rope, which groove extends transversely to the edges of the teeth so that each edge includes first and second segments separated by the groove, each of the first and second segments of each edge thereby having an end portion disposed toward the groove with which to grip the rope against such movement.

5. A rope cleat as recited in claim 4, wherein:

the edges of the teeth of the rope abutment structure are disposed generally toward the edges of the teeth of the cam; and the groove in the cam faces the groove in the rope abutment structure.

6. A rope cleat, comprising:

a base, a rope abutment structure on the base, a cam, and means for mounting the cam on the base so that the cam can rotate about a rotational axis for purposes of gripping a rope between the cam and the rope abutment structure;

the rope abutment structure having a plurality of teeth, each of which teeth has an edge disposed generally toward the cam; and means for enhancing the gripping of a rope having a known diameter against movement between the cam and the rope abutment structure along a path that is generally tangential relative to the rotational axis, including a groove in the rope abutment structure that has a width less than the known diameter of the rope;

the groove extending transversely to the edges of the teeth so that each edge includes first and second segments separated by the groove, each of the first and second segments of each edge thereby having an end portion disposed toward the groove with which to grip the rope against such movement.

* * * * *